US005549252A

United States Patent [19]

Walter

[11] Patent Number: 5,549,252

[45] Date of Patent: Aug. 27, 1996

[54] WATER-HAMMER ACTUATED CRUSHER

[75] Inventor: Bruno H. Walter, North Vancouver, Canada

[73] Assignee: Industrial Sound Technologies, Inc., British Columbia, Canada

[21] Appl. No.: 277,250

[22] Filed: Jul. 18, 1994

[51] Int. Cl.[6] ..... B02C 1/02; B02C 1/04

[52] U.S. Cl. ..... 241/264; 241/265

[58] Field of Search ..... 241/264, 265; 173/200, 201, 204

[56] References Cited

U.S. PATENT DOCUMENTS

| | | | |
|---|---|---|---|
| 2,392,560 | 1/1946 | Vitoux | 173/200 |
| 3,456,742 | 7/1969 | James | 173/200 |
| 4,406,416 | 9/1983 | Tateishi | 241/269 |
| 4,410,145 | 10/1983 | Koch | 241/264 |
| 4,676,323 | 6/1987 | Henriksson | 173/116 |
| 5,102,303 | 4/1992 | Gobaud | 417/226 |

FOREIGN PATENT DOCUMENTS

| | | | |
|---|---|---|---|
| 2621043 | 12/1976 | Germany | 241/264 |
| 4213483A1 | 4/1992 | Germany . | |
| 510300 | 4/1976 | U.S.S.R. . | |
| 1100013 | 6/1984 | U.S.S.R. | 241/264 |
| 2141657 | 1/1985 | United Kingdom | 173/200 |
| WO94/10452 | 5/1994 | WIPO . | |

*Primary Examiner*—John M. Husar
*Attorney, Agent, or Firm*—Oyen wiggs Green & Mutala

[57] ABSTRACT

A crusher for materials such as rock is described. Material is crushed between an inclined anvil and a vibrating impact surface. The impact surface is driven by high intensity pressure pulses which are generated by creating repeated water hammers in a low pressure high volume hydraulic circuit. The water hammer may act directly to drive a piston bearing the impact surface toward the anvil. In another configuration of the invention, the water hammer pulse stores energy by stretching a tension member or by distorting a plate. When the water hammer pulse passes the stored energy suddenly drives the impact surface towards the anvil. The crusher of the invention has few moving parts and is energy efficient.

26 Claims, 11 Drawing Sheets

WATER-HAMMER ACTUATED CRUSHER

FIELD OF THE INVENTION

This Invention relates to a device for crushing materials into small fragments and/or powder. The invention has particular application in the field of crushing rocks.

BACKGROUND OF THE INVENTION

Rock crushers are used in mining to reduce an ore to smaller particles and powder from which minerals may be extracted. Prior art rock crushers often have many moving parts. This makes them expensive to manufacture and maintain. Most prior art crushers use a large amount of energy to crush a given volume of rock. This makes such crushers expensive to operate.

SUMMARY OF THE INVENTION

This invention provides high crushing force from a low pressure, high velocity, fluid supply. The fluid is caused to flow in a conduit and water-hammer is generated in the conduit. The water-hammer results in a high pressure pulse which is harnessed to crush materials.

Accordingly, the invention provides a crusher comprising: a crusher body; a member movably mounted in the crusher body, the member bearing an impact surface; an anvil fixed relative to the body and facing the impact surface; a space between the anvil and the impact surface for receiving material to be crushed between the impact surface and the anvil; a fluid filled chamber in the body, the chamber having a movable wall linked to the member; a fluid filled conduit in fluid communication with the chamber; a valve in the conduit downstream from the chamber; means for causing the fluid to flow in the conduit past the chamber and through the valve; and, means for repeatedly opening and closing the valve to generate a series of water-hammers in the conduit.

BRIEF DESCRIPTION OF THE DRAWINGS

In drawings which illustrate embodiments of the invention.

DETAILED DESCRIPTION OF THE PREFERRED EMBODIMENT

Figure 1:
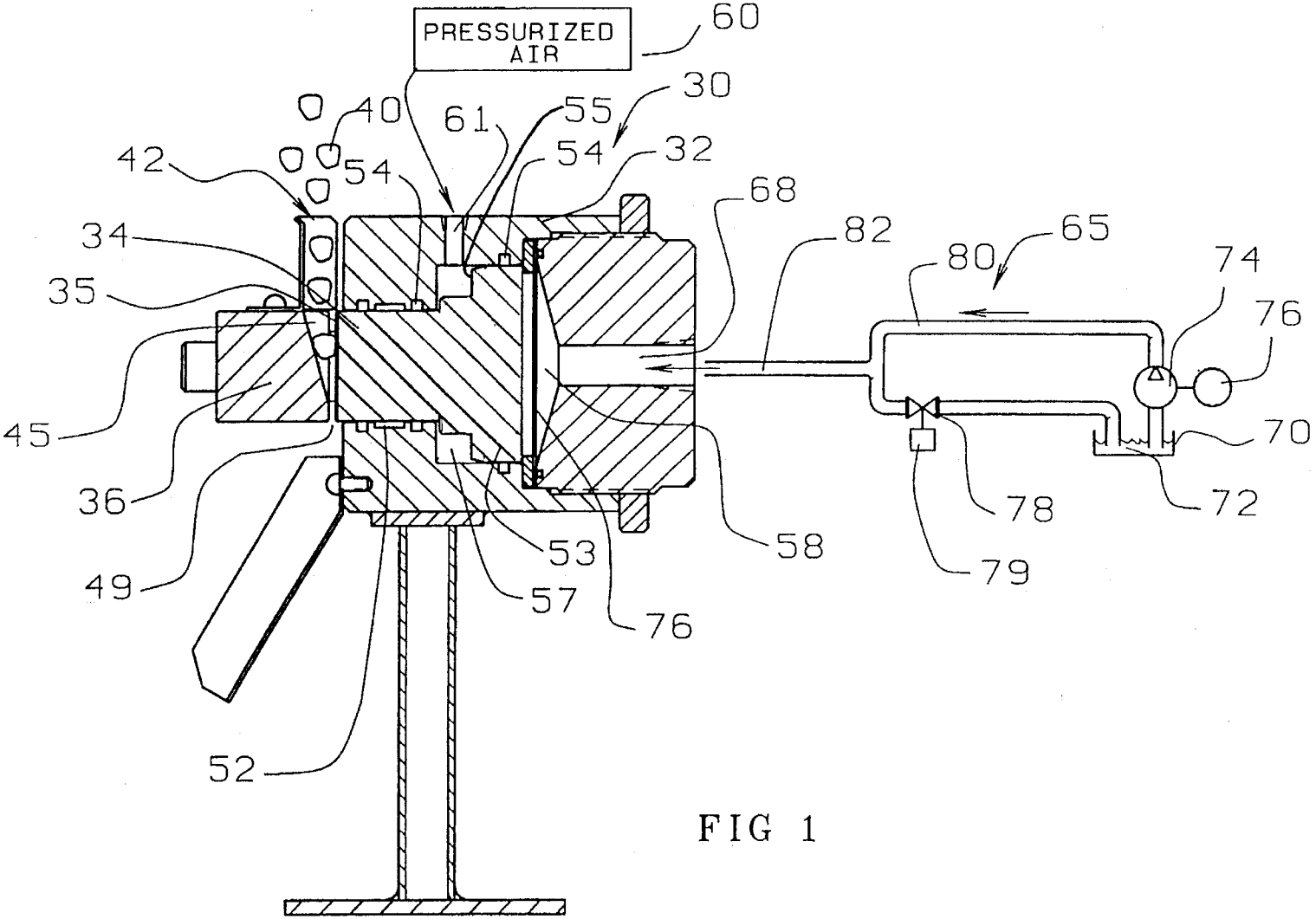
FIG. 1 is an elevational section through a crusher according to the invention with a schematic view of a hydraulic system for driving the crusher.

As shown in FIG. 1, crusher 30 comprises a body 32 having a piston 34 slidably mounted within it. An impact surface 35 of piston 34 extends through an opening in body 32. An inclined anvil 36 is mounted to body 32 adjacent impact surface 35.

Rocks 40 (or other material) to be crushed are fed into a hopper 42 from where they fall into a wedge shaped region 45 between impact surface 35 and anvil 36. As will be discussed further below, piston 34 is driven by water hammer to produce sudden impacts of impact surface 35 on rocks wedged between impact surface 35 and anvil 36. The impact of impact surface 35 on rocks 40 received in region 45 causes rocks 40 to fracture.

The motions of impact surface 35 transmit sonic energy into rocks 40 which are wedged between impact surface 35 and anvil 36. Portions of these rocks break off. The resulting pieces of rock fall further downward in region 45 until they are wedged between impact surface 35 and anvil. 36 where further breaking takes place. Eventually the rock is broken into pieces fine enough to exit through slit 49 at the bottom of wedge shaped region 45. The vibration of impact surface 35 helps to shake up rock in wedge shaped region 45 to keep rocks 40 moving downward.

The maximum size of crushed rock pieces exiting crusher 30 may be adjusted by varying the width of slit 49. This may be accomplished, for example, by moving anvil 36 toward or away from body 32.

The angle of inclination, θ, of anvil 36 to impact surface 35 is preferably small enough that rocks 40 are not driven upwardly on anvil 36 by the force applied to rocks 40 by impact surface 35. That is, the frictional forces between rocks 40 and impact surface 35 and between rocks 40 and anvil 36 should be sufficient to counteract the upwardly directed component of force which results from anvil 36 being at an angle to the vertical. The optimum angle θ, will therefore vary depending upon the material being crushed.

Piston 34 is preferably round in section and is mounted in body 32 on a bushing 52 or other suitable bearing surface which permits some longitudinal motion of piston 34. Piston 34 has a larger diameter end 53 away from impact surface 35. Larger diameter end 53 is larger in diameter than the end of piston 34 which bears impact surface 35. A step 55 separates larger and smaller diameter ends of piston 34. Both ends of piston 34 are sealingly fitted into body 32 with seals 54.

Chambers 57 and 58 are formed in body 32 on the sides of larger diameter end 53 toward and away from impact surface 35 respectively. Chamber 57 is connected to a pressurized air supply 60 through an inlet 61. The air pressure in chamber 57 acts on step 55 to bias piston 34 toward chamber 58. As a less preferable alternative, piston 34 may be biased toward chamber 58 by a spring, a block of resilient material or a hydraulic piston.

Chamber 58 is filled with a fluid and is connected to a hydraulic circuit 65 through an inlet 68. Chamber 58 should not contain any significant pockets of air (or other gas). Vents (not shown) may be provided at the top of chamber 58 for use in purging any air which may be present in chamber 58 after chamber 58 is initially filled with fluid.

Chamber 58 is closed on one side by larger diameter end 53 of piston 34. A flexible membrane 76 may be provided in chamber 58 to prevent fluid from hydraulic circuit 65 from contacting piston 34. This may be necessary if, for example, the fluid in hydraulic circuit 65 contains chemicals which could corrode piston 34.

The motion of piston 34 is driven by hydraulic circuit 65. Hydraulic circuit 65 comprises a reservoir 70 of a working fluid 72 such as water or hydraulic fluid, a pump 74 driven by a motor 76, a valve 78, a valve controller 79 for repeatedly opening and closing valve 78, and a conduit 80 between the outlet of pump 74 and valve 78. Pump 74 is preferably a centrifugal pump. A conduit 82 is connected between a point in conduit 80 upstream from valve 78 and inlet 68 in body 32.

It can be appreciated that the function of pump 74 and motor 76 is to provide a relatively high volume and low pressure flow of fluid 72 through conduit 80 and valve 78. A suitable supply of flowing fluid could also be obtained, for example, by gravity feed from an elevated reservoir, in which case, pump 74 and motor 76 would not be required.

Controller 79 may be an electrical or electronic timer coupled with an electrically operated valve actuator or a mechanical actuator, or any other known means for repeatedly opening said valve, leaving said valve open for sufficient time for fluid to commence flowing in said conduit with sufficient velocity to create a water-hammer and then closing said valve. Preferably, the functions of controller 79 and valve 78 are accomplished by a fluid operated valve system as described below with reference to FIGS. 8 and 9.

In operation, when valve 78 is open, pump 74 pumps fluid 72 from reservoir 70 through conduit 80 and valve 78 from where it is returned to reservoir 70. The pressure in conduit 80 is slightly above atmospheric pressure. Piston 34 is displaced toward chamber 58 by pressurized air in chamber 57.

Controller 79 then suddenly closes valve 78. The sudden closure of valve 78 causes a water-hammer pressure pulse to be propagated upstream from valve 78 in conduit 80. The generation of water hammer pulses is discussed in many texts on fluid mechanics including, for example, R. L. Daugherty and J. B. Franzini, *Fluid Mechanics With Engineering Applications*, pages 425–431 McGraw Hill Book Company, 1977.

While the inventor does not wish to be bound by any particular theory of operation of crusher 30, the inventor believes that the water-hammer generated pressure pulse travels through conduit 82 into chamber 58 where it very rapidly applies an extremely large force to large end 53 of piston 34. The sudden application of force to piston 34 causes a pressure wave to travel through piston 34. This pressure wave is, in turn, transmitted into rocks 40 which are tightly wedged between impact surface 35 and anvil 36.

Figure 2:
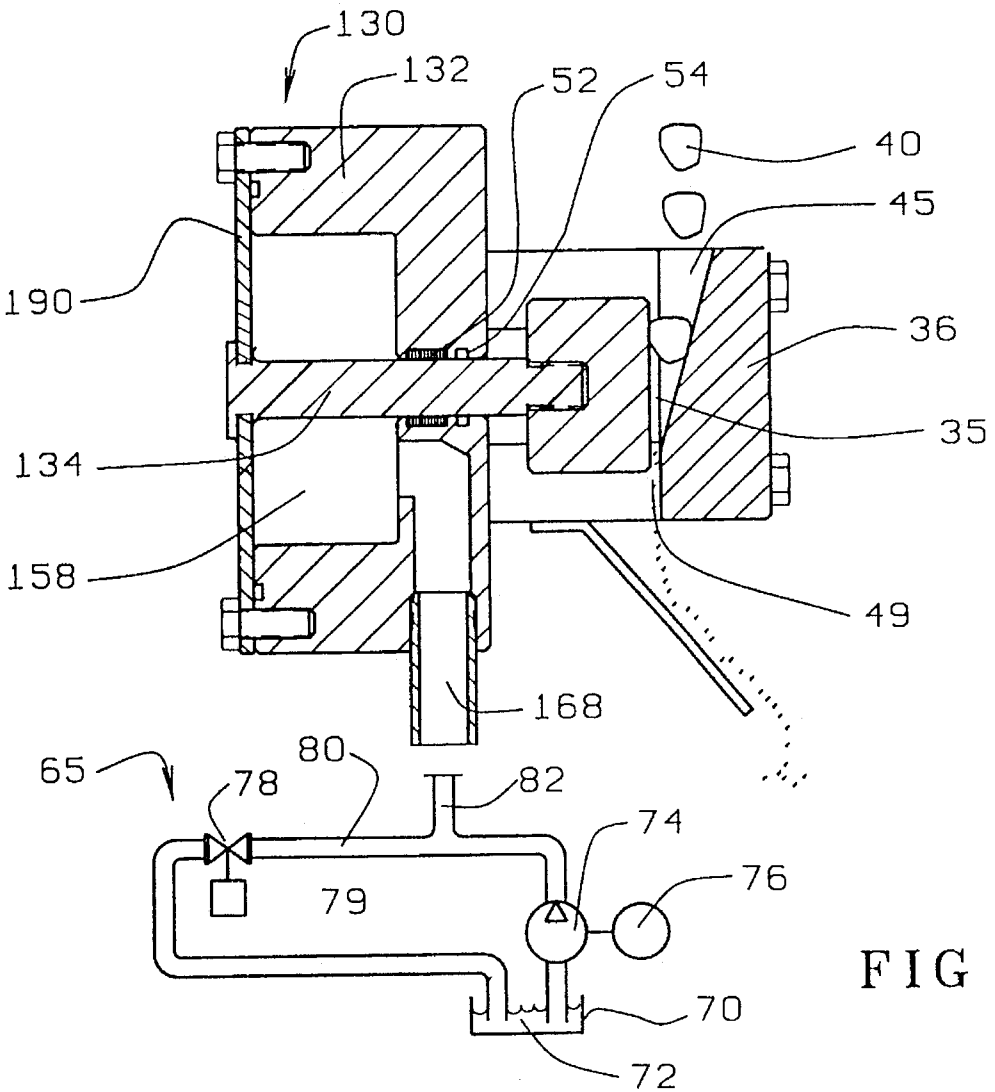
FIG. 2 is an elevational section through an alternative embodiment of the invention.

FIG. 2 shows an alternative embodiment of the invention. In rock crusher 130, impact surface 35 is mounted at one end of a rigid rod 134. Rod 134 is sealingly and slidably mounted in body 132 of crusher 130. The other end of rod 134 is mounted to a plate 190. Hydraulic circuit 65 is coupled to a chamber 158 in body 132 by inlet 168. One side of chamber 158 is formed by plate 190.

In operation, high pressure water-hammer pulses are developed in hydraulic circuit 65 as described above. The pressure pulses travel into chamber 158 where the pressure forces plate 190 outward away from anvil 36. The motion of plate 190 draws rod 134 and impact surface 35 slightly away from anvil 36. When the water hammer pressure pulse passes, plate 190 snaps back into its normal position. In doing so it very suddenly snaps impact surface 35 toward anvil 36. The sudden motion of impact surface 35 crushes rocks 40 between impact surface 35 and anvil 36 as described above.

Preferably, plate 190 has a resonant mode of oscillation so that plate 190 continues to "ring" after a pressure pulse has set it into motion. The ringing causes rod 134 to vibrate longitudinally, thus causing impact surface 35 to vibrate against rocks 40. Rod 134 is preferably mounted at a position on plate 190 corresponding to an anti-node of the resonant mode of oscillation. The high amplitude acoustic vibrations transmitted into rocks 40 by impact surface 35 help to fracture rocks 40.

The inventor considers that for optimal crushing of brittle materials such as rocks 40 it is generally desirable to apply compressional forces to the materials very suddenly. Preferably compression is applied to rocks 40 so suddenly that the portions of rocks 40 near impact surface 35 are under significant stress while other portions of rocks 40 are substantially unstressed. For this to happen, impact surface 35 should deliver compressional forces to rocks 40 in a time shorter than the time necessary for a compressional wave to travel through rocks 40 at the speed of sound in rocks 40.

Figure 3:
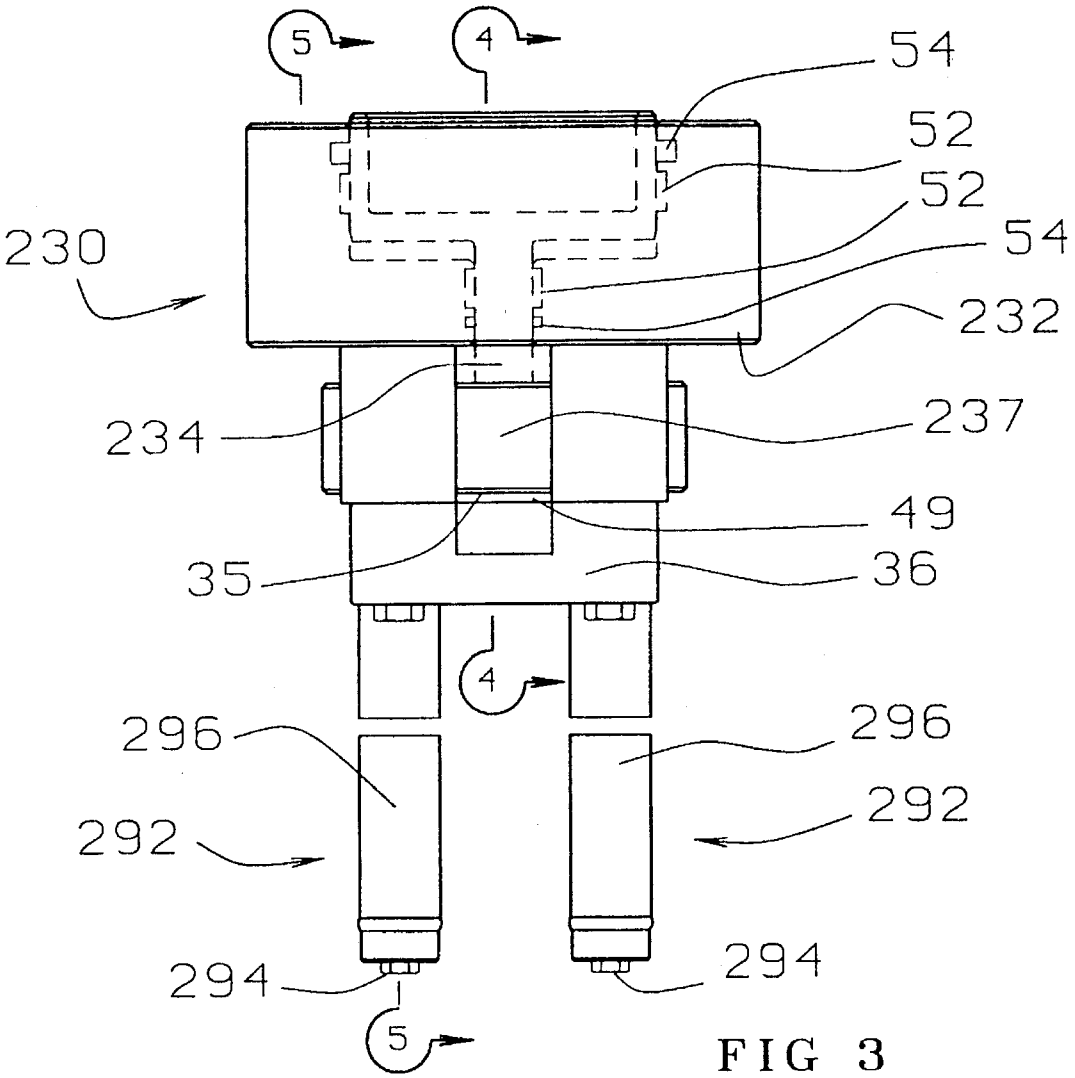
FIG. 3 is a top plan view of a crusher according to a second alternative embodiment of the invention.
Figure 4:
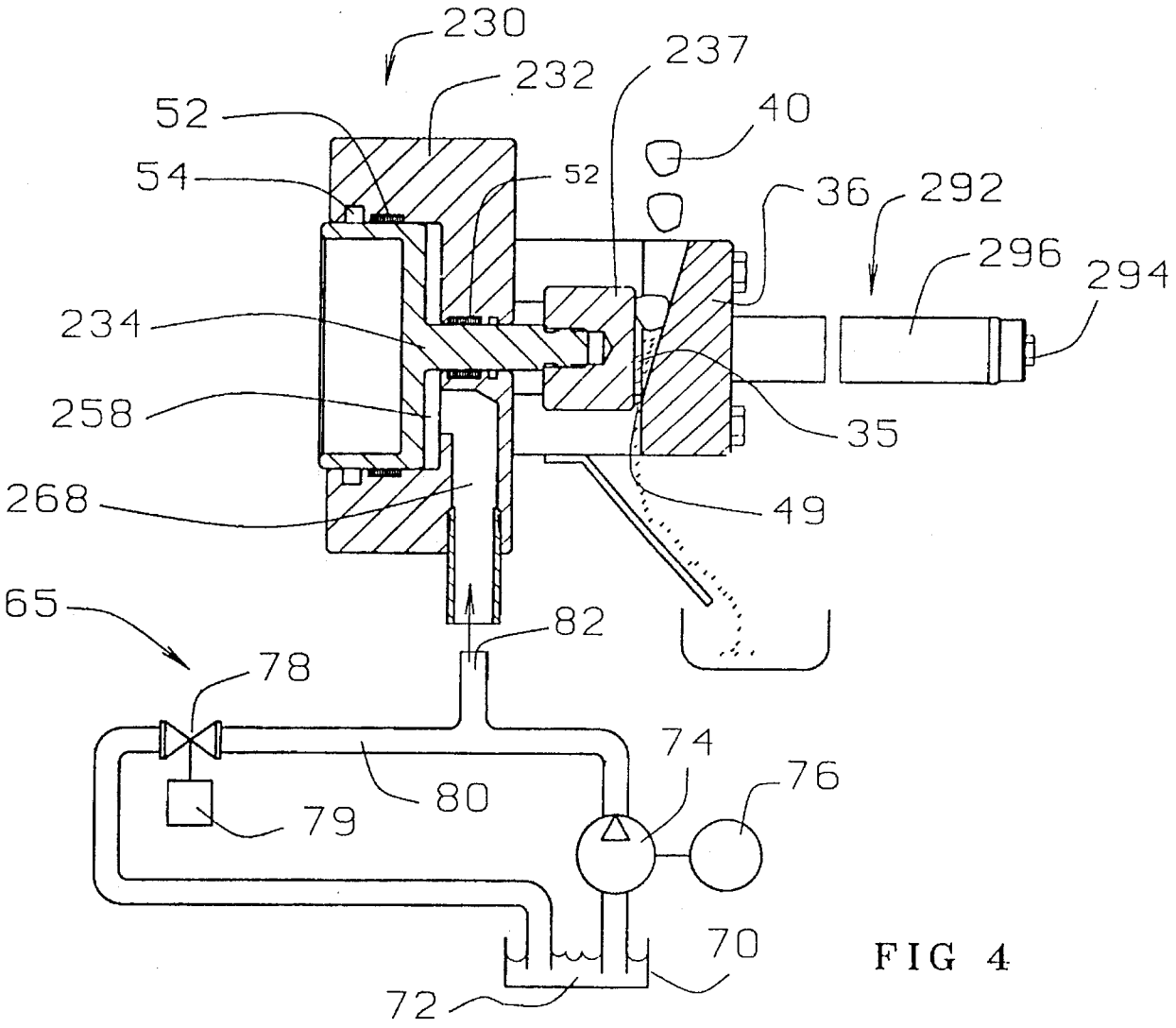
FIG. 4 is an elevational section in the plane 4—4 of the crusher of FIG. 3.
Figure 6:
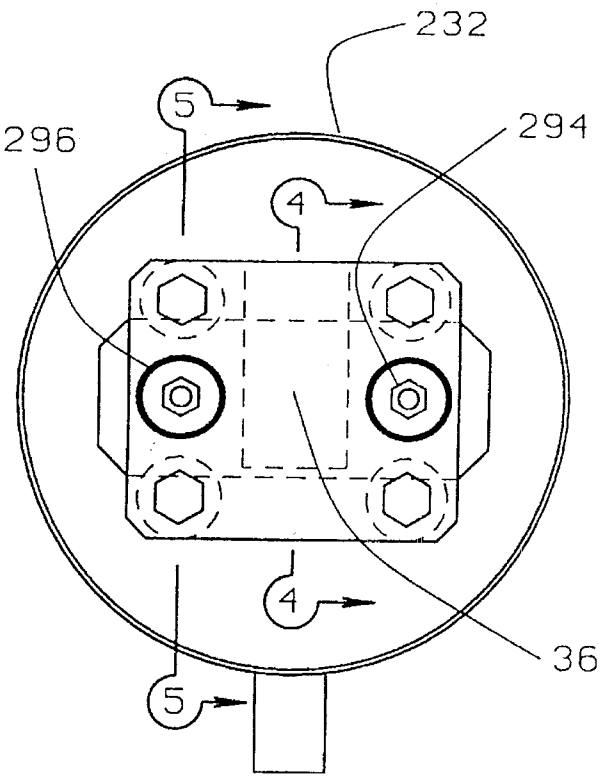
FIG. 6 is a front elevation of the crusher of FIG. 3.
Figure 5:
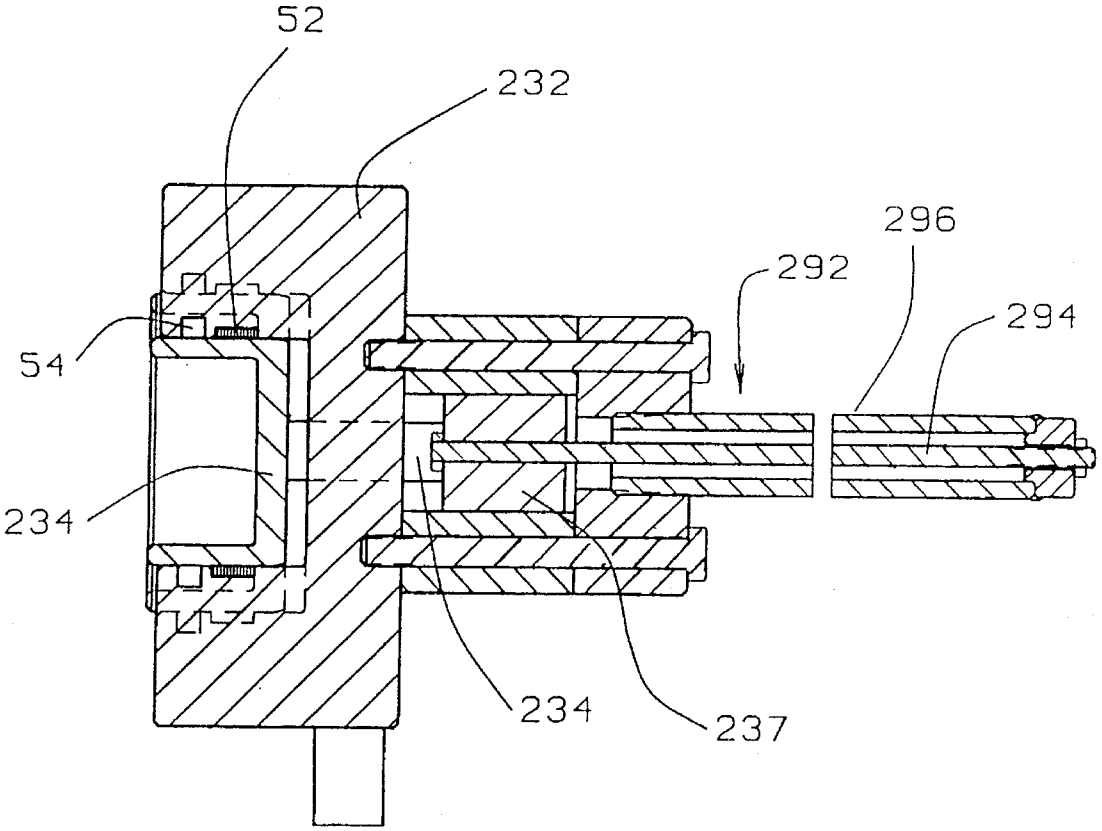
FIG. 5 is an elevational section in the plane 5—5 of the crusher of FIG. 3.

FIGS. 3 through 6 show a second alternative embodiment of the invention in which impact surface 35 can deliver a compressional impact to rocks 40 very quickly. In crusher 230, as shown in FIG. 3, impact surface 35 is on a block 237. Block 237 is connected to a piston 234 which is slidably and sealingly mounted in a body 232. Block 237 is held toward anvil 36 by tension elements 292. In FIGS. 3 through 6, tension elements 292 comprise a tensioned rod 294 lying within a tube 296. Rods 294 may be, for example, high tensile strength steel rods. Alternative tension elements, such as tightly stretched wires or cables or tightly stretched carbon fiber rods could be used in place of tension elements 292.

High pressure water hammer pulses generated by hydraulic circuit 65 travel through conduit 82 and inlet 268 into a chamber 258. The wall of chamber 258 away from block 237 is closed by piston 234. The high pressure pulse forces piston 234 away from anvil 36. Piston 234 pulls block 237 with it, thus tensioning rods 294 in tension elements 292. Energy from the high pressure pulse is stored in rods 294. Rods 294 act as very stiff springs. Because they are stiff, rods 294 are capable of suddenly releasing to impact surface 35 the energy which is stored in them when they are stretched by a water hammer pulse. When the high pressure pulse passes, tension elements 292 snap block 237 toward anvil 36 thereby crushing rocks 40 between impact surface 35 and anvil 36. The inventor believes that the embodiment of the invention shown in FIGS. 3–6 is capable of applying compressional stresses to rocks 40 more suddenly than the embodiment shown in FIG. 1.

Figure 7:
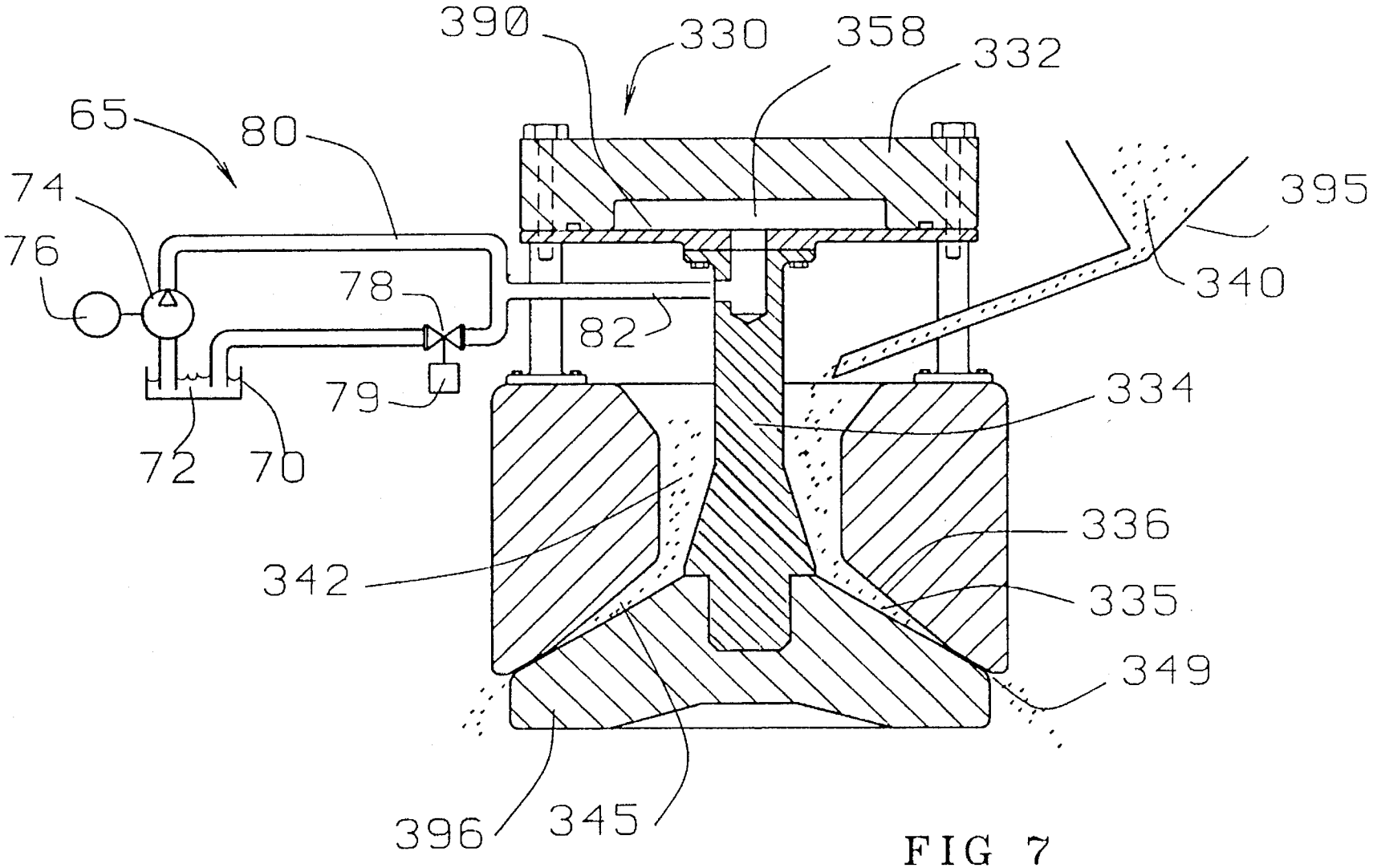
FIG. 7 is an elevational section through a crusher according to a third embodiment of the invention.

FIG. 7 shows an alternative crusher 330. In crusher 330 gravel is crushed between an impact surface 335 and a toroidal anvil 336. Impact surface 335 is on a member 396. Member 396 is moved by water-hammer pressure pulses created, as described above, in a hydraulic circuit 65.

Hydraulic circuit 65 is connected to a chamber 358 in a rigid body 332. One side of chamber 358 is closed by a plate 390. Plate 390 is connected to member 396 by a rigid rod 334. When a water hammer pulse is generated in hydraulic circuit 65 a very high pressure pulse travels through conduit 82 into chamber 358. The pressure pulse bulges plate 390 outwardly and moves impact surface 335 away from anvil 336. When the water-hammer pressure pulse passes, plate 390 suddenly snaps back toward its equilibrium position thereby jerking impact surface 335 toward anvil 336.

Gravel 340, which may be in the form of a slurry, is fed from a hopper 395 into a toroidal space 342 between rod 334 and toroidal anvil 336. From space 342 gravel 340 drops under the influence of gravity into wedge shaped toroidal space 345 between anvil 336 and impact surface 335 where it is crushed.

Member 396 may optionally be rotatably coupled to rod 334. Drive means (not shown) may then be provided to turn member 396 during the crushing process. This provides a "milling" action which further breaks down the material being crushed.

The embodiment of FIG. 7 uses a driving mechanism similar to that shown in FIG. 2. It is to be understood that a crusher having a toroidal anvil 336 and an impact surface 335 as shown in FIG. 7 could readily be constructed with a driving mechanism analogous to one of the driving mechanisms shown in the embodiments of FIG. 1, FIGS. 3 through 6, FIG. 11 or FIG. 12.

Figure 8:
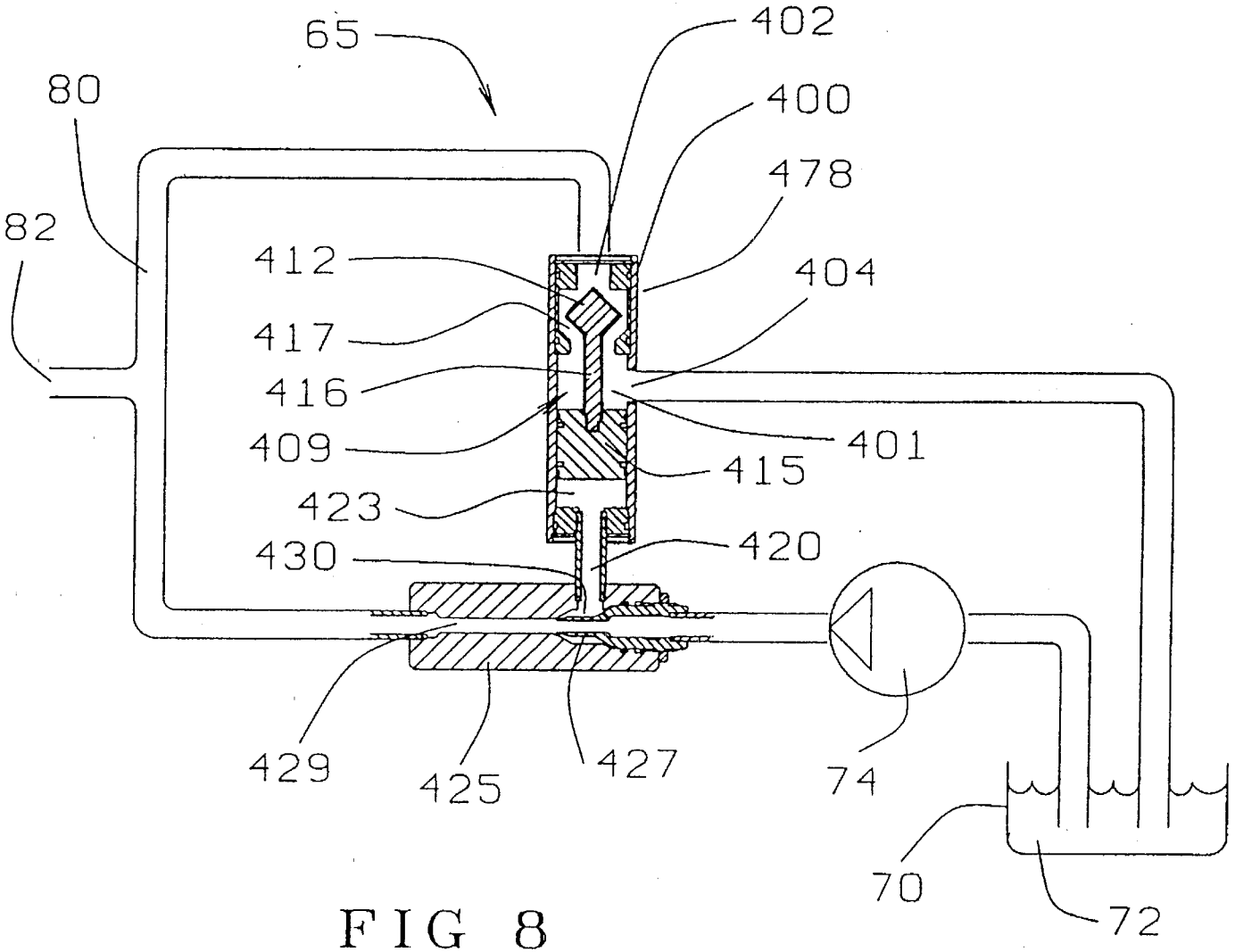
FIG. 8 is a partially schematic view of a preferred hydraulic driving circuit according to the invention.

FIG. 8 shows a preferred hydraulic circuit 65 for generating water hammer according to the invention. Hydraulic circuit 65 comprises a reservoir 70 containing fluid 72, a pump 74, a valve 478 and a conduit 80 connecting pump 74 to valve 478. Fluid 72 is drawn from reservoir 70 by pump 74, pumped through conduit 80 to valve 478 and then returned to reservoir 70.

Valve 478 comprises a valve body 400 having an internal cavity 401 with an inlet 402 and an outlet 404. A shuttle 409 is slidably mounted within cavity 401. A Sealing member 412 is mounted to shuttle 409 at its end toward inlet 402. A piston 415 is mounted at the other end of shuttle 409 past outlet 404. Sealing member 412 and piston 415 are connected by a rod 416.

When shuttle 409 is toward inlet 402 valve 478 is open. When shuttle 409 moves away from inlet 402, sealing member 412 contacts valve seat 417 thus blocking the flow of fluid from inlet 402 and outlet 404.

Piston 415 divides cavity 401 into two portions. Inlet 402 and outlet 404 are on one side of piston 415. A control port 420 extends into a region 423 of chamber 401 on the other side of piston 415 away from outlet 404.

Control port 420 is connected to a venturi unit 425 in conduit 80 between pump 74 and valve 478. Venturi unit 425 comprises a nozzle 427 which is directed into a narrowed section 429 in conduit 80. Control port 420 is connected to an annular space 430 surrounding nozzle 427. Venturi unit 425 functions as an aspirator to reduce the pressure at control port 420 when fluid is flowing quickly through nozzle 427.

The operation of hydraulic circuit 65 will now be described. If valve 478 is initially closed (i.e. shuttle 409 is fully away from inlet 402 so that sealing member 412 is in contact with valve seat 417) then valve 478 is opened by fluid pressure generated by pump 74 in region 423. Pump 74 pressurizes the fluid in conduit 80. The fluid pressure in region 423 and at inlet 402 are equal. Because the area of the lower end of piston 415 is greater than the area of the opening in valve seat 417 the fluid pressure in region 423 forces shuttle 409 toward inlet 402 thus opening valve 478.

With valve 478 open, fluid begins to flow through conduit 80. As the rate of fluid flow through conduit 80 increases the pressure at control port 420 decreases due to the Bernoulli effect. The decreased pressure at control port 420 draws fluid out of region 423 and brings shuttle 409 downward closing valve 478.

The sudden closure of valve 478 while fluid is quickly flowing in conduit 80 causes a water-hammer shock wave to propagate upstream from valve 478. When the water-hammer shock wave reaches venturi unit 425 it propagates through control port 420 into region 423. In region 423 the high pressure water-hammer pulse acts on piston 415 and throws shuttle 409 toward inlet 402 thereby opening valve 478. Once valve 478 has been opened the cycle repeats. It can be appreciated that the frequency of operation of valve 478 is determined by the length of conduit 80 between valve 478 and venturi unit 425, the speed at which water hammer pulses propagate through the fluid in conduit 80, and the rate of flow of fluid in conduit 80.

The water-hammer pressure pulse is harnessed to do useful work by means of conduit 82 which transmits the pressure pulse to a crusher, as described above, or some other piece of water-hammer operated equipment. Preferably conduit 82 is short.

Figure 9:
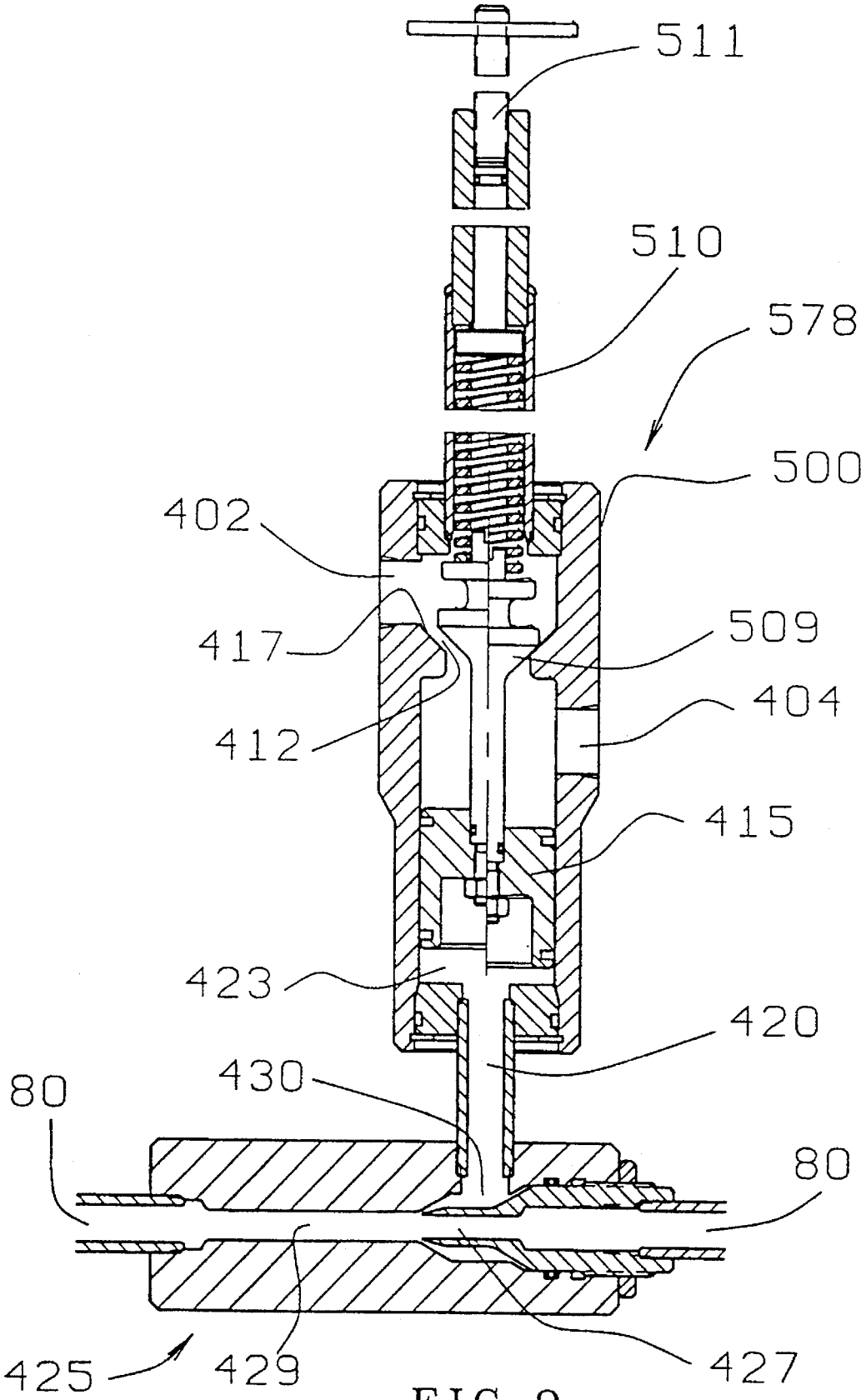
FIG. 9 is an elevational section through an alternative valve for use in the hydraulic driving circuit of FIG. 8.

FIG. 9 shows an alternative valve 578 which may be used in the hydraulic circuit of FIG. 8. In FIG. 9, two positions of shuttle 509 are shown. The right-hand side of FIG. 9 shows shuttle 509 in its "closed" position. The left-hand side of FIG. 9 shows shuttle 509 in its "open" position. At a given time, shuttle 509 is either in its "open" position or its "closed" position or somewhere between these positions. Valve 578 differs from valve 478 in that shuttle 509 is biased toward its "closed" position by a spring 510. The force applied by spring 510 to shuttle 509 may be adjusted by means of a screw 511. The frequency of operation of valve 578 may be adjusted by changing the bias force on shuttle 509. In general, increasing the bias force on shuttle 509 causes valve 578 to cycle more quickly.

Figure 10:
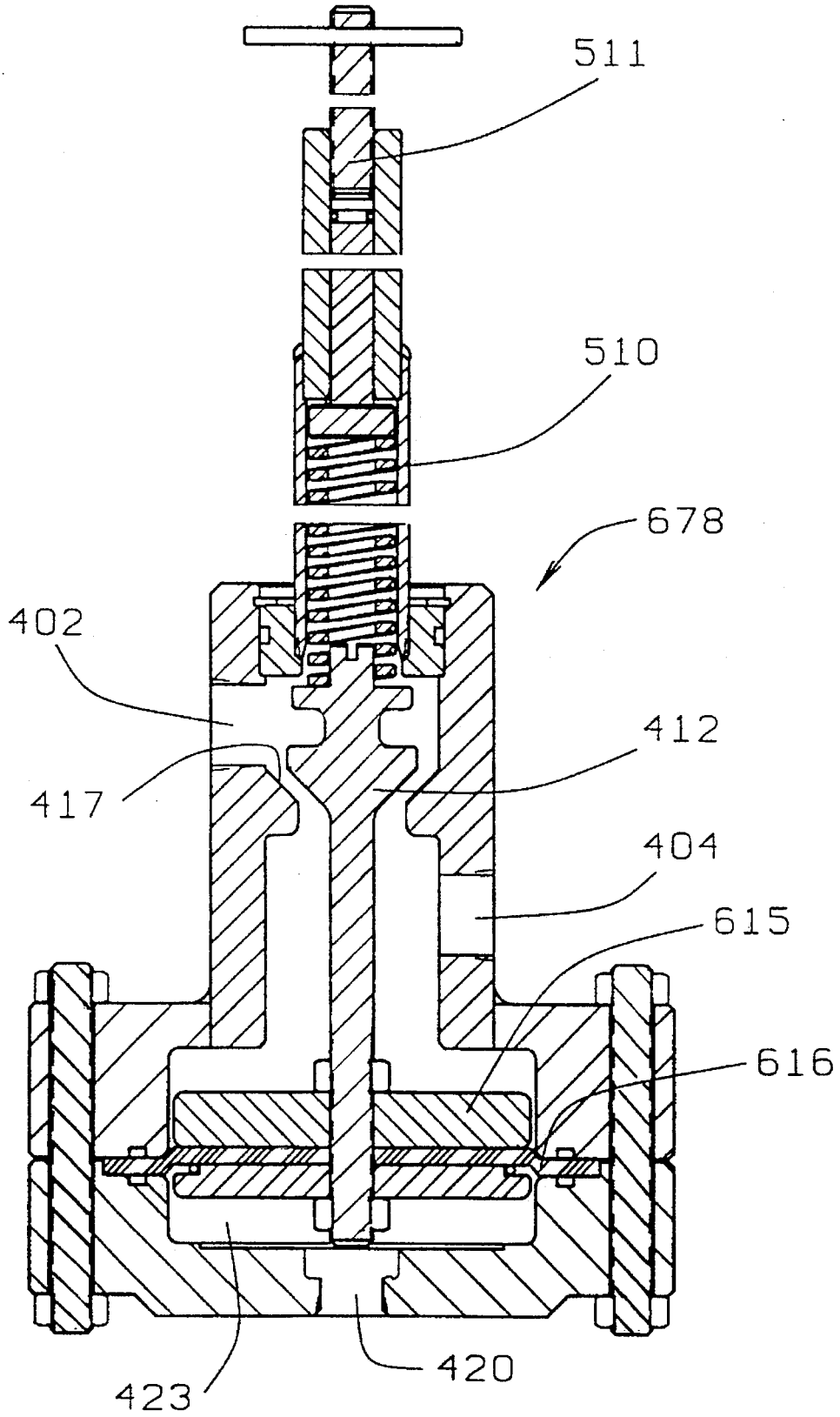
FIG. 10 is an elevational section through a modified alternative valve for use in the hydraulic driving circuit of FIG. 8.

FIG. 10 shows another alternative valve 678. Valve 678 differs from valve 578 in that piston 615 is sealed and supported by a flexible diaphragm 616 instead of by sliding seals 54. Diaphragm 616 allows sufficient movement of piston 615 to open and close valve 678.

EXAMPLE

A small rock crusher as shown in FIG. 1 having a piston 34 8 inches in diameter was driven by a hydraulic circuit in which pump 74 was a 2 horsepower centrifugal pump having a maximum output pressure of 100 pounds per square inch (p.s.i.) and a maximum throughput of 24 gallons per minute (g.p.m.). Conduit 80 was ½ inch diameter XS Schedule 80 pipe and valve 78 was a valve 578 as shown in FIG. 9. Valve 78 was operated at a frequency in the range of 9–20 Hz. The angle of inclination of anvil 36 was 15°. It was found that the crusher was able to quickly reduce samples of granite with dimensions of approximately 2 inches by 3 inches to small fragments and powder.

Figure 11:
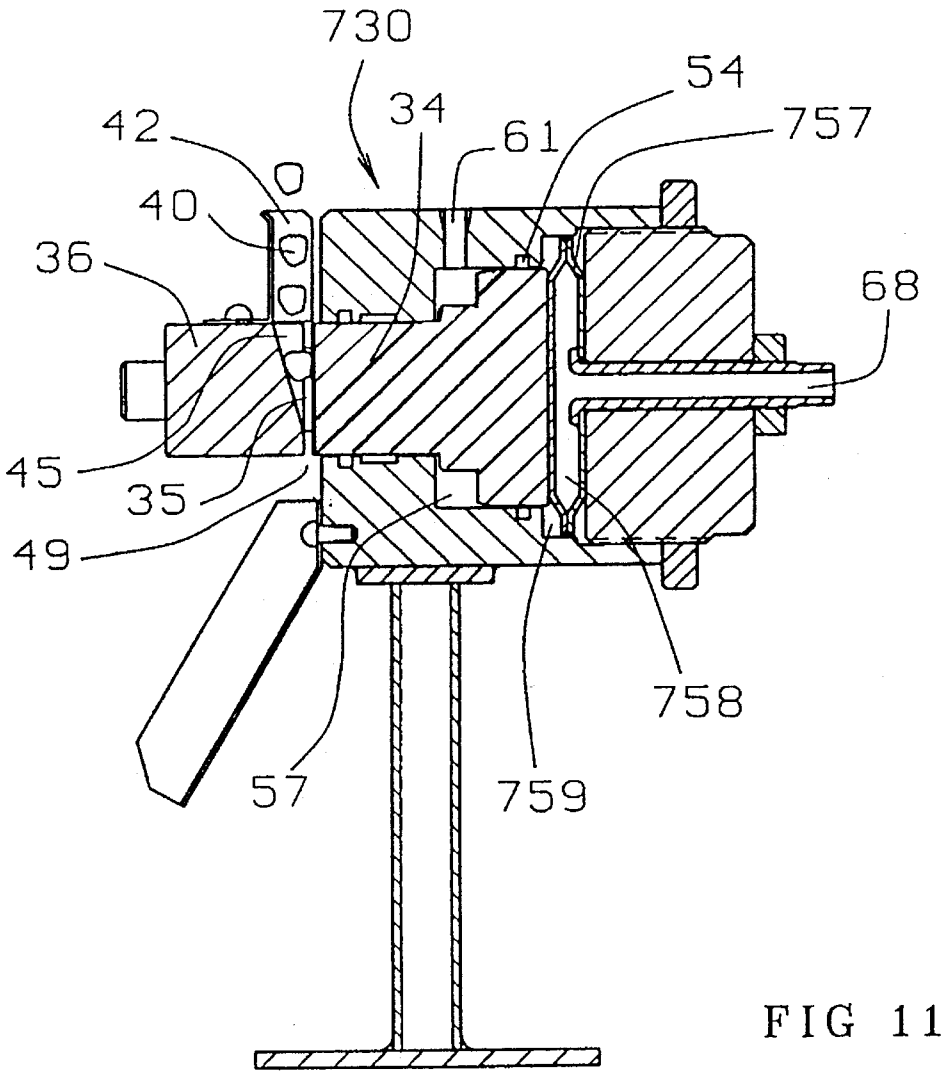
FIG. 11 is an elevational section through a crusher according to a fourth embodiment of the invention.
Figure 12:
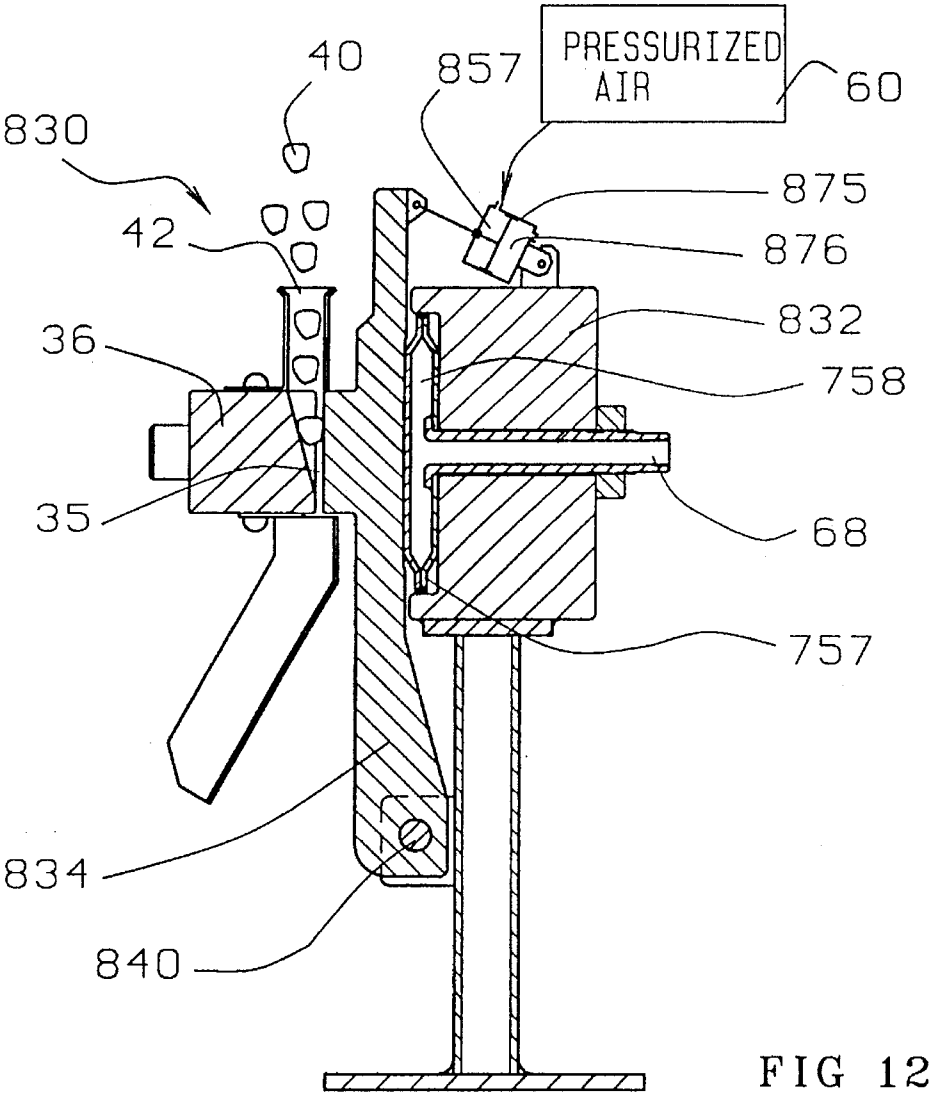
FIG. 12 is an elevational section through a crusher according to a fifth embodiment of the invention.

It can be appreciated that many alternative embodiments of the invention are possible. By way of example only, FIGS. 11 and 12 show two further embodiments of the invention. FIG. 11 shows a crusher 730. Crusher 730 differs from crusher 30 of FIG. 1 in that piston 34 is not in direct contact with a fluid filled chamber 58 but is instead in contact with an element 757 which encloses a chamber 758. Element 757 may comprise, for example, a pair of metal elements bolted or welded together around their periphery, a reinforced rubberized bladder or the like. Element 757 should not be completely rigid so that water-hammer pressure pulses delivered to chamber 758 through inlet 68 can act on piston 34. Crusher 730 is advantageous because it does not require seals 54 between chamber 57 and chamber 758 to seal against high pressure water-hammer generated pulses.

FIG. 12 shows a crusher 830 according to a further embodiment of the invention. In crusher 830 impact surface 35 is on a member 834 which is mounted to body 832 by a pivot 840. Water-hammer generated pressure pulses are delivered to chamber 758 which is enclosed by element 757. The pressure pulses deform element 757 slightly and transmit motion into member 834 to crush rocks 40 between impact surface 35 and anvil 36. Air cylinder 875 is connected between body 832 and member 834. Air cylinder 875 contains a chamber 857 which is connected to a source 60 of pressurized air. The pressurized air in chamber 857 acts on a piston 876 to pull member 834 toward body 832. A suitable alternative biasing means may be used in place of air cylinder 875.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A crusher comprising (a) a substantially rigid-walled substantially unimpeded conduit having an inlet at an upstream end thereof and an outlet at a downstream end thereof, said substantially unimpeded conduit filled with a fluid;

(b) a supply of said fluid at a first pressure connected to said inlet of said substantially unimpeded conduit;

(c) a valve in said conduit downstream from said inlet, said valve having an open position, wherein said fluid is free to flow continuously from said supply through said substantially unimpeded conduit and said valve, and a closed position, wherein said flow of said fluid through said substantially unimpeded conduit is substantially blocked by said valve;

(d) a crusher body;

(e) a fluid-filled chamber in said crusher body;

(f) means for repeatedly opening said valve, maintaining said valve open for a time sufficient for said fluid to commence flowing through said valve with a velocity, and suddenly closing said valve to generate a series of water-hammers in said substantially unimpeded conduit, each of said water hammers comprising an upstream propagating water-hammer pulse having a pressure significantly greater than said first pressure;

(g) a fluid-filled conduit for carrying said water-hammer pulses into said fluid-filled chamber, said fluid-filled conduit extending from a point said substantially unimpeded conduit upstream from said valve to said fluid-filled chamber;

(h) an anvil mounted to said crusher body; and (i) a rigid member mounted in and having a projecting end projecting from said crusher body, said member extending between said fluid filled chamber and an impact surface on said projecting end, said member displaceable by said water-hammer pulses to transmit sudden compressive forces to a material to be crushed between said impact surface and said anvil.

2. The crusher of claim 1 wherein said anvil is inclined relative to said impact surface.

3. The crusher of claim 1 wherein said member comprises a piston sealingly and slidably mounted in an aperture in said body and said fluid-filled chamber abuts one end of said piston.

4. The crusher of claim 3 wherein said aperture is sealed around said piston by a flexible diaphragm extending between said piston and said body.

5. The crusher of claim 3 further comprising bias means associated with said piston for biasing said piston toward said chamber.

6. The crusher of claim 5 wherein said bias means comprises a sealed second chamber in said body and a source of compressed air connected to said second chamber wherein said piston passes through said second chamber and said piston has a greater cross sectional area where it enters said second chamber on a side of said second chamber closest to said chamber and a smaller cross sectional area where it enters said second chamber on a side of said second chamber away from said chamber.

7. The crusher of claim 1 wherein said valve comprises:

a) a valve body;

b) a cavity in said valve body;

c) a piston sealingly and slidably mounted in said cavity, said piston dividing said cavity into first and second sections, said piston having a first position toward said second section and a second position toward said first section;

d) fluid connections to said inlet and an outlet in said first section;

e) a fluid connection to a control port in said second section;

f) a valve seat between said inlet and said outlet in said first section; and g) a sealing member linked to said piston for sealing against said valve seat to block flow of said fluid from said inlet to said outlet when said piston is in said first position;

and wherein said means for repeatedly opening and closing said valve comprises an aspirator in said conduit upstream from said valve, said aspirator in fluid communication with said control port.

8. The crusher of claim 7 wherein said aspirator comprises a nozzle coupled to said conduit, and an annular space around said nozzle, and said control port is coupled to said annular region by a second conduit.

9. The crusher of claim 1 wherein said chamber is enclosed by a deformable element having an outer surface in contact with said member.

10. The crusher of claim 9 wherein said deformable element comprises a flattened metal shell.

11. The crusher of claim 9 wherein said deformable element comprises a reinforced elastic bladder.

12. The crusher of claim 1 wherein a displaceable wall of said fluid-filled chamber comprises a metal plate having peripheral edges affixed to said body and said member comprises a rod having one end mounted to said plate at a point away from said peripheral edges and said impact surface is at another end of said rod.

13. The crusher of claim 12 wherein a portion of said rod between said impact surface and said plate passes through said chamber wherein an increase in pressure of said fluid in said chamber tends to move said impact surface away from said anvil.

14. The crusher of claim 13 wherein said plate has an oscillatory mode and said plate is free to resonantly oscillate with respect to said body in said oscillatory mode wherein oscillation in said oscillatory mode may be induced by delivering a sudden pressure pulse to said chamber.

15. The crusher of claim 14 wherein said point away from said peripheral edges is an anti-node of said oscillatory mode.

16. The crusher of claim 1 further comprising a tension member coupled between said member and a mounting point fixed relative to said crusher body, wherein said chamber comprises a displaceable wall connected to said tension member and disposed such that an increase in pressure of said fluid in said chamber tends to move said impact surface away from said anvil and tends to increase tension on said tension member.

17. The crusher of claim 16 wherein said mounting point is at a first end of a hollow tube having a second end affixed to said body and said tension member extends through a bore of said tube.

18. The crusher of claim 16 wherein said tension member comprises a steel rod.

19. The crusher of claim 16 wherein said tension member comprises a metallic cable.

20. A crusher comprising:

a) a body;

b) a member pivotally mounted to said body;

c) an impact surface on a side of said member away from said body;

d) an anvil fixed relative to said body adjacent said impact surface;

e) a space between said anvil and said impact surface for receiving material to be crushed between said impact surface and said anvil;

f) a fluid filled chamber in said body, said chamber having a movable wall linked to said member;

g) a fluid filled conduit having an upstream end and a downstream end, said fluid filled conduit in fluid communication with said chamber;

h) a valve in said conduit downstream from said chamber, said valve having an open position, wherein said fluid is free to flow continuously through said conduit and said valve, and a closed position, wherein said flow of said fluid through said conduit is substantially blocked by said valve;

i) means for causing said fluid to flow in said conduit past said chamber and through said valve; and, j) means for repeatedly opening and closing said valve to generate a series of water-hammers in said conduit.

21. Apparatus for generating repeated water hammer pressure pulses in a conduit, said apparatus comprising:

(a) a conduit;

(b) a source of fluid at a first pressure connected to an upstream end of said conduit;

(c) a valve in said conduit, said valve having an open position, wherein said fluid is free to flow from said source continuously through said conduit and said valve, and a closed position, wherein said flow of said fluid through said conduit is substantially blocked by said valve, said valve comprising:

i) a valve body;

ii) a cavity in said valve body;

iii) a piston sealingly and slidably mounted in said cavity, said piston dividing said cavity into first and second sections, said piston movable between a first position toward said second section and a second position toward said first section;

iv) fluid connections to said inlet and an outlet in said first section;

v) a fluid connection to a control port in said second section;

vi) a valve seat between said inlet and said outlet in said first section; and vii) a sealing member movable by said piston for sealing against said valve seat to block flow of said fluid from said inlet to said outlet when said piston is in said first position; and, (d) an aspirator in said conduit upstream from said valve, said aspirator in fluid communication with said control port.

22. The apparatus of claim 21 wherein said aspirator comprises a nozzle, an annular space around said nozzle, and said control port is coupled to said annular space by a conduit.

23. A method for crushing brittle objects, said method comprising the steps of:

(a) providing a supply of a fluid at a first pressure;

(b) placing material to be crushed between an impact surface on a member and a surface;

(c) causing said fluid to flow from said supply through a substantially rigid-walled conduit and through a valve;

(d) while said fluid is flowing through said valve, suddenly closing said valve to block flow of said fluid through said conduit and said valve, thereby creating a water hammer pulse having a pressure significantly greater than said first pressure within said conduit;

(e) allowing said water hammer pulse to propagate upstream from said valve and into a fluid-filled chamber having a wall linked to said member;

(f) allowing said water hammer pulse to act on said wall of said fluid-filled chamber to suddenly displace said member to cause said member to transmit a sudden compressional force to a surface of said material to be crushed; and, (g) repeating said steps (c) through (f) until said material to be crushed has been broken into fragments no larger than a desired size.

24. The method of claim 23 wherein said step (c) includes allowing said fluid to flow through an aspirator upstream from said valve to create a reduced pressure within said aspirator and wherein, in said step (d), said valve is closed by said reduced pressure acting upon a movable member in said valve.

25. The method of claim 24 wherein said valve is reopened by said water hammer pulse propagating through said aspirator and acting on said movable member after said step (d).

26. The method of claim 23 wherein said step (f) comprises allowing said water hammer pulse to displace said member to draw said impact surface away from said material to be crushed and simultaneously stretch a tension element and, after said water hammer pulse passes, allowing said tension element to displace said member to transmit said sudden compressional force to said surface of said material to be crushed.

* * * * *